US007856357B2

(12) United States Patent
Mizutani et al.

(10) Patent No.: US 7,856,357 B2
(45) **Date of Patent: *Dec. 21, 2010**

(54) SPEECH SYNTHESIS METHOD, SPEECH SYNTHESIS SYSTEM, AND SPEECH SYNTHESIS PROGRAM

(75) Inventors: Tatsuya Mizutani, Ome (JP); Takehiko Kagoshima, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/193,530

(22) Filed: Aug. 18, 2008

(65) Prior Publication Data

US 2008/0312931 A1 Dec. 18, 2008

Related U.S. Application Data

(62) Division of application No. 10/996,401, filed on Nov. 26, 2004, now Pat. No. 7,668,717.

(30) Foreign Application Priority Data

Nov. 28, 2003 (JP) ..... 2003-400783

(51) Int. Cl.
*G10L 13/00* (2006.01)

(52) U.S. Cl. ..... 704/261; 704/258; 704/260

(58) Field of Classification Search ..... 704/220, 704/260, 258, 266, 261, 268, 270, 270.1, 704/243, 236

See application file for complete search history.

(56) References Cited

U.S. PATENT DOCUMENTS 6,240,384 B1 * 5/2001 Kagoshima et al. ..... 704/220
6,665,641 B1 * 12/2003 Coorman et al. ..... 704/260
6,701,295 B2 * 3/2004 Beutnagel et al. ..... 704/258
2007/0168189 A1 7/2007 Tamura et al.
2008/0027727 A1 1/2008 Morita et al.

FOREIGN PATENT DOCUMENTS

| | | |
|---|---|---|
| JP | 2583074 | 11/1996 |
| JP | 9-244693 | 9/1997 |
| JP | 9-319394 | 12/1997 |
| JP | 2001-282278 | 10/2001 |
| JP | 3281281 | 2/2002 |
| JP | 2003-271171 | 9/2003 |

OTHER PUBLICATIONS

Andrew J. Hunt, et al. "Unit Selection in a Concatenative Speech Synthesis System Using a Large Speech Database", Proc. ICASSP-96, 1996, pp. 373-376.

Takehiko Kagoshima et al., "Automatic Generation of Synthesis Units by Units Selection Based on Closed-Loop Training", IEICE Journal D-11, Japan, Institute of Electronics, Information and Communication Engineers, Sep. 25, 1998, vol. J81-D-11, No. 9, pp. 1949-1954.

* cited by examiner

*Primary Examiner*—Huyen X. Vo
(74) *Attorney, Agent, or Firm*—Oblon, Spivak, McClelland, Maier & Neustadt, L.L.P.

(57) ABSTRACT

A speech synthesis system stores a group of speech units in a memory, selects a plurality of speech units from the group based on prosodic information of target speech, the speech units selected corresponding to each of segments which are obtained by segmenting a phoneme string of the target speech and minimizing distortion of synthetic speech generated from the speech units selected to the target speech, generates a new speech unit corresponding to the each of the segments, by fusing the speech units selected, to obtain a plurality of new speech units corresponding to the segments respectively, and generates synthetic speech by concatenating the new speech units.

10 Claims, 13 Drawing Sheets

| Segment number | Phoneme (Phoneme symbol) | Fundamental frequency | Duration |
|---|---|---|---|
| 0 | /a/ | 221Hz | 83msec |
| 1 | /a/ | 296Hz | 125msec |
| 2 | /i/ | 240Hz | 61msec |
| ⋮ | ⋮ | ⋮ | ⋮ |

2

SPEECH SYNTHESIS METHOD, SPEECH SYNTHESIS SYSTEM, AND SPEECH SYNTHESIS PROGRAM

CROSS-REFERENCE TO RELATED APPLICATIONS

This application is a division of and claims the benefit of priority under 35 U.S.C. §120 from U.S. application Ser. No. 10/996,401, filed Nov. 26, 2004, and claims the benefit of priority under 35 U.S.C. §119 from Japanese Patent Application No. 2003-400783, filed Nov. 28, 2003, the entire contents of which are incorporated herein by reference.

BACKGROUND OF THE INVENTION

1. Field of the Invention

Text-to-speech synthesis is to artificially create a speech signal from arbitrary text. The text-to-speech synthesis is normally implemented in three stages, i.e., a language processing unit, prosodic processing unit, and speech synthesis unit.

2. Description of the Related Art

Input text undergoes morphological analysis, syntactic parsing, and the like in the language processing unit, and then undergoes accent and intonation processes in the prosodic processing unit to output phoneme string and prosodic features or suprasegmental features (pitch or fundamental frequency, duration or phoneme duration time, power, and the like). Finally, the speech synthesis unit synthesizes a speech signal from the phoneme string and the prosodic features. Hence, a speech synthesis method used in the text-to-speech synthesis must be able to generate synthetic speech of an arbitrary phoneme symbol string with arbitrary prosodic features.

Conventionally, as such speech synthesis method, feature parameters having small synthesis units (e.g., CV, CVC, VCV, and the like (V=vowel, C=consonant)) are stored (these parameters will be referred to as typical speech units), and are selectively read out. And the fundamental frequencies and duration of these speech units are controlled, then these segments are connected to generate synthetic speech. In this method, the quality of synthetic speech largely depends on the stored typical speech units.

As a method of automatically and easily generating typical speech units suitably used in speech synthesis, for example, a technique called context-oriented clustering (COC) is disclosed (e.g., See Japanese Patent No. 2,583,074). In COC, a large number of pre-stored speech units are clustered based on their phonetic environments, and typical segments are generated by fusing speech units for respective clusters.

The principle of COC is to divide a large number of speech units assigned with phoneme names and environmental information (information of phonetic environments) into a plurality of clusters that pertain to phonetic environments on the basis of distance scales between speech units, and to determine the centroids of respective clusters as typical speech units. Note that the phonetic environment is a combination of factors which form an environment of the speech unit of interest, and the factors include the phoneme name, preceding phoneme, succeeding phoneme, second succeeding phoneme, fundamental frequency, duration, power, presence/absence of stress, position from an accent nucleus, time from breath pause, utterance speed, emotion, and the like of the speech unit of interest.

Since phonemes in actual speech undergo phonological changes depending on phonetic environments, typical segments are stored for a plurality of respective clusters that pertain to phonetic environments, thus allowing generation of natural synthetic speech in consideration of the influence of phonetic environments.

As a method of generating typical speech units with higher quality, a technique called a closed loop training method is disclosed (e.g., see Japanese Patent No. 3,281,281). The principle of this method is to generate typical speech units that minimize distortions from natural speech on the level of synthetic speech which is generated by changing the fundamental frequencies and duration. This method and COC have different schemes for generating typical speech units from a plurality of speech units: the COC fuses segments using centroids, but the closed loop training method generates segments that minimize distortions on the level of synthetic speech.

Also, a segment selection type speech synthesis method, which synthesizes speech by directly selecting a speech segment string from a large number of speech units using the input phoneme string and prosodic information (information of prosodic features) as a target, is known. The difference between this method and the speech synthesis method that uses typical speech units is to directly select speech units from a large number of pre-stored speech units on the basis of the phoneme string and prosodic information of input target speech without generating typical speech units. As a rule upon selecting speech units, a method of defining a cost function which outputs a cost that represents a degree of deterioration of synthetic speech generated upon synthesizing speech, and selecting a segment string to minimize the cost is known. For example, a method of digitizing deformation and concatenation distortions generated upon editing and concatenating speech units into costs, selecting a speech unit sequence used in speech synthesis based on the costs, and generating synthetic speech based on the selected speech unit sequence is disclosed (e.g., see Jpn. Pat. Appln. KOKAI Publication No. 2001-282278). By selecting an appropriate speech unit sequence from a large number of speech units, synthetic speech which can minimize deterioration of sound quality upon editing and concatenating segments can be generated.

The speech synthesis method that uses typical speech units cannot cope with variations of input prosodic features (prosodic information) and phonetic environments since limited typical speech units are prepared in advance, thus there occurs deteriorating sound quality upon editing and concatenating segments.

On the other hand, the speech synthesis method that selects speech units can suppress deterioration of sound quality upon editing and concatenating segments since it can select them from a large number of speech units. However, it is difficult to formulate a rule that selects a speech unit sequence that sounds naturally as a cost function. As a result, since an optimal speech unit sequence cannot be selected, the sound quality of synthetic speech deteriorates. The number of speech units used in selection is too large to practically eliminate defective segments in advance. Since it is also difficult to reflect a rule that removes defective segments in design of a cost function, defective segments are accidentally mixed in a speech unit sequence, thus deteriorating the quality of synthetic speech.

BRIEF SUMMARY OF THE INVENTION

The present invention relates to a speech synthesis method and system for text-to-speech synthesis and, more particularly, to a speech synthesis method and system for generating a speech signal on the basis of a phoneme string and prosodic features (prosodic information) such as the fundamental frequency, duration, and the like.

According to a first aspect of the present invention, there is provided a method which includes selecting a plurality of speech units from a group of speech units, based on prosodic information of target speech, the speech units selected corresponding to each of segments which are obtained by segmenting a phoneme string of the target speech; generating a new speech unit corresponding to the each of segments, by fusing speech units selected, to obtain a plurality of new speech units corresponding to the segments respectively; and generating synthetic speech by concatenating the new speech units.

According to a second aspect of the present invention, there is provided a speech synthesis method for generating synthetic speech by concatenating speech units selected from a first group of speech units based on a phoneme string and prosodic information of target speech, the method includes: storing a second group of speech units and environmental information items (fundamental frequency, duration, and power and the like) corresponding to the second group of respectively in a memory; selecting a plurality of speech units from the second group based on each of training environmental information items (fundamental frequency, duration, and power and the like), the speech units selected whose environmental information items being similar to the each of the training environmental information items; and generating each of speech units of the first group, by fusing the speech units selected.

DETAILED DESCRIPTION OF THE INVENTION

Preferred embodiments of the present invention will be described below with reference to the accompanying drawings.

First Embodiment

Figure 1:
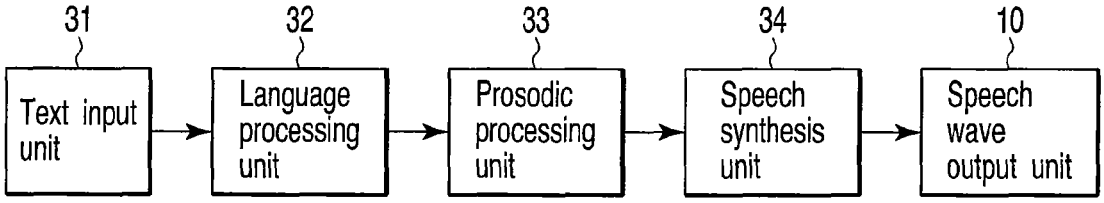
FIG. 1 is a block diagram showing the arrangement of a speech synthesis system according to the first embodiment of the present invention.

FIG. 1 is a block diagram showing the arrangement of a text-to-speech system according to the first embodiment of the present invention. This text-to-speech system has a text input unit 31, language processing unit 32, prosodic processing unit 33, speech synthesis unit 34, and speech wave output unit 10. The language processing unit 32 makes morphological analysis and syntactic parsing of text input from the text input unit 31, and sends that result to the prosodic processing unit 33. The prosodic processing unit 33 executes accent and intonation processes on the basis of the language analysis result to generate a phoneme string (phoneme symbol string) and prosodic information, and sends them to the speech synthesis unit 34. The speech synthesis unit 34 generates a speech wave on the basis of the phoneme string and prosodic information. The generated speech wave is output via the speech wave output unit 10.

Figure 2:
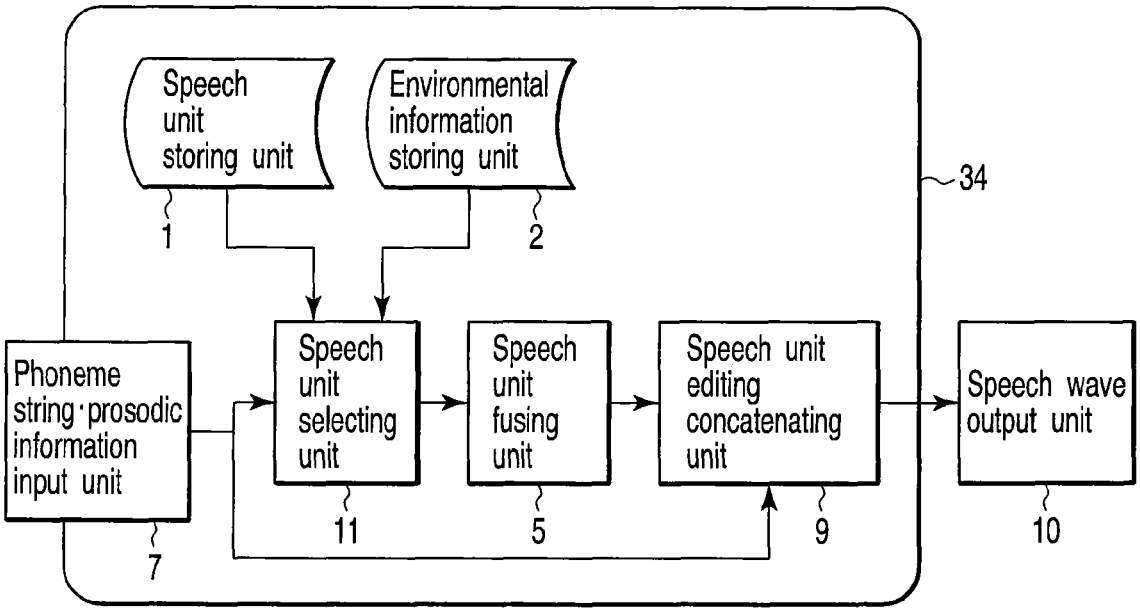
FIG. 2 is a block diagram showing an example of the arrangement of a speech synthesis unit.

FIG. 2 is a block diagram showing an example of the arrangement of the speech synthesis unit 34 of FIG. 1. Referring to FIG. 2, the speech synthesis unit 34 includes a speech unit storing unit 1, environmental information storing unit 2, phoneme string/prosodic information input unit 7, speech unit selecting unit 11, speech unit fusing unit 5, and speech unit editing/concatenating unit 9.

The speech unit storing unit 1 stores speech units in large quantities, and the environmental information storing unit 2 stores environmental information (information of phonetic environments) of these speech units. The speech unit storing unit 1 stores speech units as units of speech (synthesis units) used upon generating synthetic speech. Each synthesis unit is a combination of phonemes or segments obtained by dividing phonemes (e.g., semiphones, monophones (C, V), diphones (CV, VC, VV), triphones (CVC, VCV), syllables (CV, V), and the like (V=vowel, C=consonant), and may have a variable length (e.g., when they are mixed). Each speech unit represents a wave of a speech signal corresponding to a synthetic unit, a parameter sequence which represents the feature of that wave, or the like.

The environmental information of a speech unit is a combination of factors that form an environment of the speech unit of interest. The factors include the phoneme name, preceding phoneme, succeeding phoneme, second succeeding phoneme, fundamental frequency, duration, power, presence/absence of stress, position from an accent nucleus, time from breath pause, utterance speed, emotion, and the like of the speech unit of interest.

The phoneme string/prosodic information input unit 7 receives a phoneme string and prosodic information of target speech output from the prosodic processing unit 33. The prosodic information input to the phoneme string/prosodic information input unit 7 includes the fundamental frequency, duration, power, and the like.

The phoneme string and prosodic information input to the phoneme string/prosodic information input unit 7 will be referred to as an input phoneme string and input prosodic information, respectively. The input phoneme string includes, e.g., a string of phoneme symbols.

The speech unit selecting unit 11 selects a plurality of speech units from those that are stored in the speech unit storing unit 1 on the basis of the input prosodic information for each of a plurality of segments obtained by segmenting the input phoneme string by synthetic units.

The speech unit fusing unit 5 generates a new speech unit by fusing a plurality of speech units selected by the speech unit selecting unit 11 for each segment. As a result, a new string of speech units corresponding to a string of phoneme symbols of the input phoneme string is obtained. The new string of speech units is deformed and concatenated by the speech unit editing/concatenating unit 9 on the basis of the input prosodic information, thus generating a speech wave of synthetic speech. The generated speech wave is output via the speech wave output unit 10.

Figure 3:
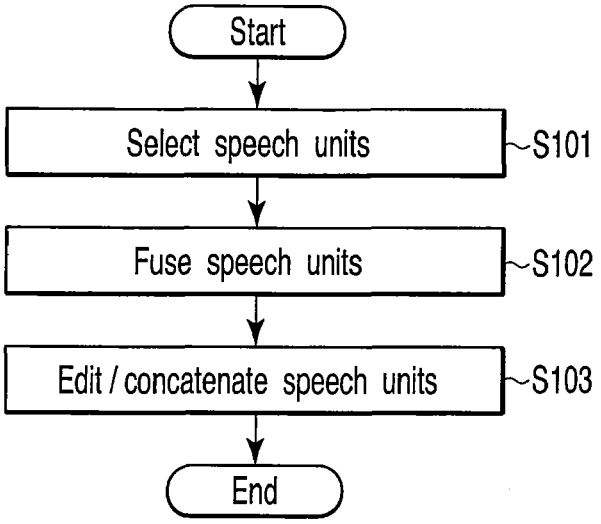
FIG. 3 is a flowchart showing the flow of processes in the speech synthesis unit.

FIG. 3 is a flowchart showing the flow of processes in the speech synthesis unit 34. In step S101, the speech unit selecting unit 11 selects a plurality of speech units from those which are stored in the speech unit storing unit 1 for each segment on the basis of the input phoneme string and input prosodic information.

A plurality of speech units selected for each segment are those which correspond to the phoneme of that segment and match or are similar to a prosodic feature indicated by the input prosodic information corresponding to that segment. Each of the plurality of speech units selected for each segment is one that can minimize the degree of distortion of synthetic speech to target speech, which is generated upon deforming that speech unit on the basis of the input prosodic information so as to generate that synthetic speech. In addition, each of the plurality of speech units selected for each segment is one which can minimize the degree of distortion of synthetic speech to target speech, which is generated upon concatenating that speech unit to that of the neighboring segment so as to generate that synthetic speech. In this embodiment, such plurality of speech units are selected while estimating the degree of distortion of synthetic speech to target speech using a cost function to be described later.

The flow advances to step S102, and the speech unit fusing unit 5 generates a new speech unit for each segment by fusing the plurality of speech units selected in correspondence with that segment. The flow advances to step S103, and a string of new speech units is deformed and concatenated on the basis of the input prosodic information, thus generating a speech wave.

The respective processes of the speech synthesis unit 34 will be described in detail below.

Figure 4:
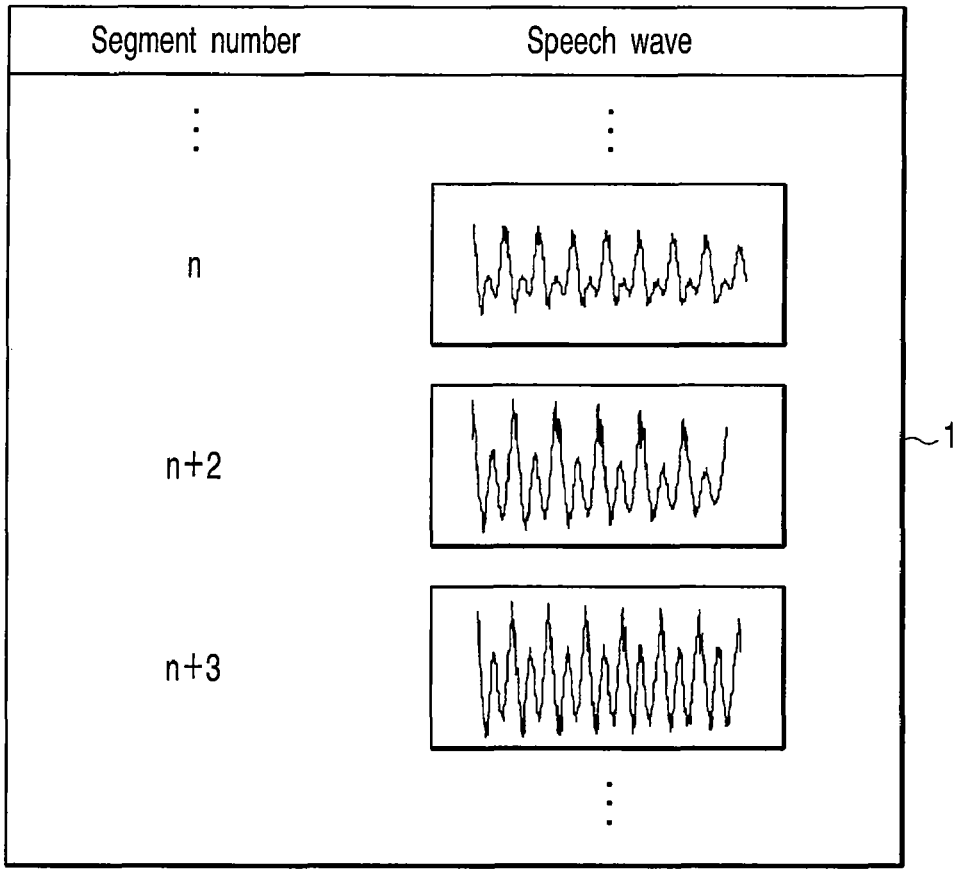
FIG. 4 shows a storage example of speech units in an environmental information storing unit.
Figures 5, 6:
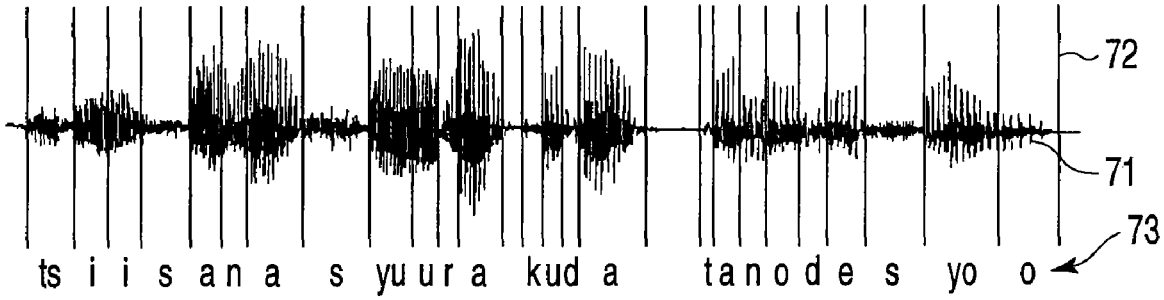
FIG. 5 shows a storage example of environmental information in the environmental information storing unit.
FIG. 6 is a view for explaining the sequence for speech units from speech data.

Assume that a speech unit as a synthesis unit is a phoneme. The speech unit storing unit 1 stores the waves of speech signals of respective phonemes together with segment numbers used to identify these phonemes, as shown in FIG. 4. Also, the environmental information storing unit 2 stores information of phonetic environments of each phoneme stored in the speech unit storing unit 1 in correspondence with the segment number of the phoneme, as shown in FIG. 5. Note that the unit 2 stores a phoneme symbol (phoneme name), fundamental frequency, and duration as the environmental information.

Speech units stored in the speech unit storing unit 1 are prepared by labeling a large number of separately collected speech data for respective phonemes, extracting speech waves for respective phonemes, and storing them as speech units.

For example, FIG. 6 shows the labeling result of speech data 71 for respective phonemes. FIG. 6 also shows phonetic symbols of speech data (speech waves) of respective phonemes segmented by labeling boundaries 72. Note that environmental information (e.g., a phoneme (in this case, phoneme name (phoneme symbol)), fundamental frequency, duration, and the like) is also extracted from each speech data. Identical segment numbers are assigned to respective speech waves obtained from the speech data 71, and environmental information corresponding to these speech waves, and they are respectively stored in the speech unit storing unit 1 and environmental information storing unit 2, as shown in FIGS. 4 and 5. Note that the environmental information includes a phoneme, fundamental frequency, and duration of the speech unit of interest.

In this case, speech units are extracted for respective phonetic units. However, the same applies to a case wherein the speech unit corresponds to a semiphone, diphone, triphone, syllable, or their combination, which may have a variable length.

The phoneme string/prosodic information input unit 7 receives, as information of phonemes, the prosodic information and phoneme string obtained by applying morphological analysis and syntactic parsing, and accent and intonation processes to input text for the purpose of text-to-speech synthesis. The input prosodic information includes the fundamental frequency and duration.

In step S101 in FIG. 3, a speech unit sequence is calculated based on a cost function. The cost function is specified as follows. Sub-cost functions $C_n(u_i, u_{i-1}, t_i)$ (n=1, . . . , N, N is the number of sub-cost functions) are defined for respective factors of distortions produced upon generating synthetic speech by deforming and concatenating speech units. Note that $t_i$ is target environmental information of a speech unit corresponding to the i-th segment if a target speech corresponding to the input phoneme string and input prosodic information is given by $t=(t_1, \ldots, t_I)$, and $u_i$ is a speech unit of the same phoneme as $t_i$ of those which are stored in the speech unit storing unit 1.

The sub-cost functions are used to calculate costs required to estimate the degree of distortion of synthetic speech to target speech upon generating the synthetic speech using speech units stored in the speech unit storing unit 1. In order to calculate the costs, we assume two types of sub-costs, i.e., a target cost used to estimate the degree of distortion of synthetic speech to target speech generated when the speech segment of interest is used, and a concatenating cost used to estimate the degree of distortion of synthetic speech to target speech generated upon concatenating the speech unit of interest to another speech unit.

As the target cost, a fundamental frequency cost which represents the difference between the fundamental frequency of a speech unit stored in the speech unit storing unit 1 and the target fundamental frequency (fundamental frequency of the target speech), and a duration cost which represents the difference between the duration of a speech unit stored in the speech unit storing unit 1 and the target duration (duration of the target speech) are used. As the concatenating cost, a spectrum concatenating cost which represents the difference between spectra at a concatenating boundary is used. More specifically, the fundamental frequency cost is calculated from:

$$C_1(u_i, u_{i-1}, t_i) = \{\log(f(v_i)) - \log(f(t_i))\}^2 \quad (1)$$

where $v_i$ is the environmental information of a speech unit $u_i$ stored in the speech unit storing unit 1, and f is a function of extracting the average fundamental frequency from the environmental information $v_i$. The duration cost is calculated from:

$$C_2(u_i, u_{i-1}, t_i) = \{g(v_i) - g(t_i)\}^2 \quad (2)$$

where g is a function of extracting the duration from environmental information $v_i$. The spectrum concatenating cost is calculated from the cepstrum distance between two speech units:

$$C_3(u_i, u_{i-1}, t_i) = \|h(u_i) - h(u_{i-1})\| \quad (3)$$

$\|x\|$ denotes norm of x where h is a function of extracting a cepstrum coefficient at the concatenating boundary of the speech unit $u_i$ as a vector. The weighted sum of these sub-cost functions is defined as a synthesis unit cost function:

$$C(u_i, u_{i-1}, t_i) = \sum_{n=1}^{N} w_n C_n(u_i, u_{i-1}, t_i) \quad (4)$$

where $w_n$ is the weight of each sub-cost function. In this embodiment, all $w_n$ are equal to "1" for the sake of simplicity. Equation (4) represents a synthetic unit cost of a given speech unit when that speech unit is applied to a given synthetic unit (segment).

The sum total of calculation results of synthetic unit costs from equation (4) for respective segments obtained by segmenting the input phoneme string by synthesis units for all the segments is called a cost, a cost function required to calculate that cost is defined by:

$$\text{cost} = \sum_{i=1}^{I} C(u_i, u_{i-1}, t_i) \quad (5)$$

Figure 7:
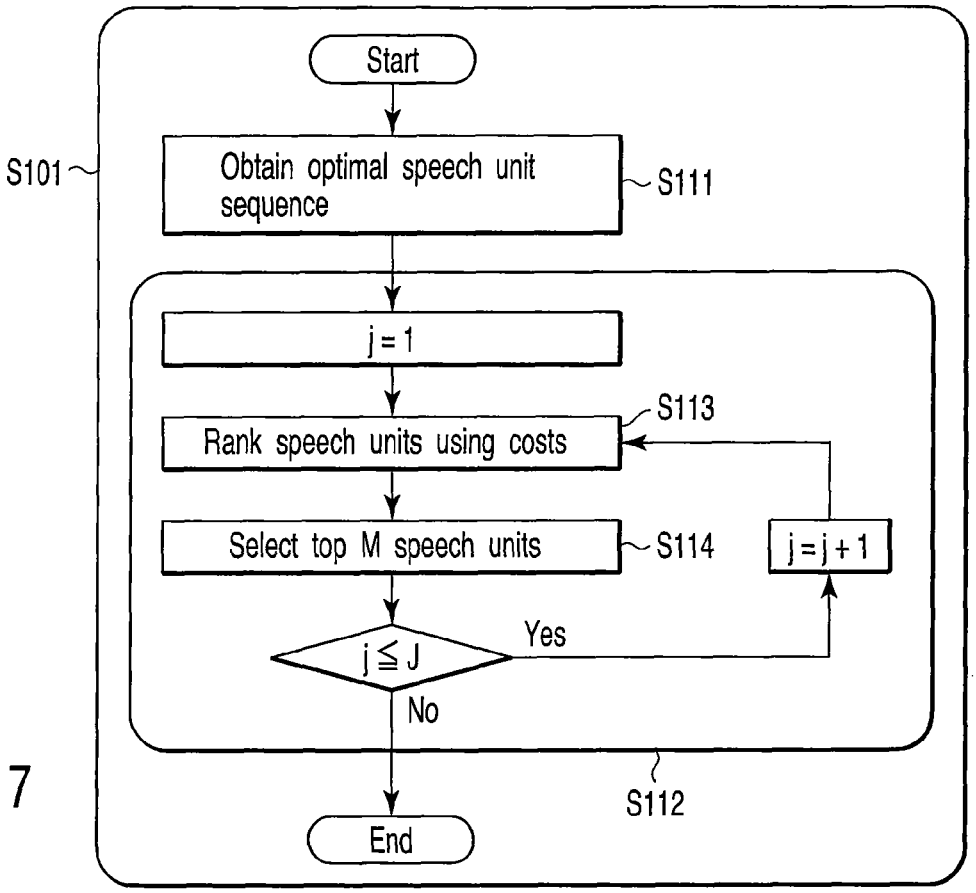
FIG. 7 is a flowchart for explaining the processing operation of a speech unit selecting unit.

In step S101 in FIG. 3, a plurality of speech units per segment (per synthesis unit) are selected in two stages using the cost functions given by equations (1) to (5) above. Details of this process are shown in the flowchart of FIG. 7.

As the first speech unit selection stage, a speech unit sequence which has a minimum cost value calculated from equation (5) is obtained from speech units stored in the speech unit storing unit 1 in step S111. A combination of speech units, which can minimize the cost, will be referred to as an optimal speech unit sequence hereinafter. That is, respective speech units in the optimal speech unit sequence respectively correspond to a plurality of segments obtained by segmenting the input phoneme string by synthesis units. The value of the cost calculated from equation (5) using the synthesis unit costs calculated from the respective speech units in the optimal speech unit sequence is smaller than those calculated from any other speech unit sequences. Note that the optimal speech unit sequence can be efficiently searched using DP (dynamic programming).

The flow advances to step S112. In the second speech unit selection stage, a plurality of speech units per segment are selected using the optimal speech unit sequence. In the following description, assume that the number of segments is J, and M speech units are selected per segment. Details of step S112 will be described below.

In steps S113 and S114, one of J segments is selected as a target segment. Steps S113 and S114 are repeated J times to execute processes so that each of J segments becomes a target segment once. In step S113, speech units in the optimal speech unit sequence are fixed for segments other than the target segment. In this state, speech units stored in the speech unit storing unit 1 are ranked for the target segment to select top M speech units.

Figure 8:
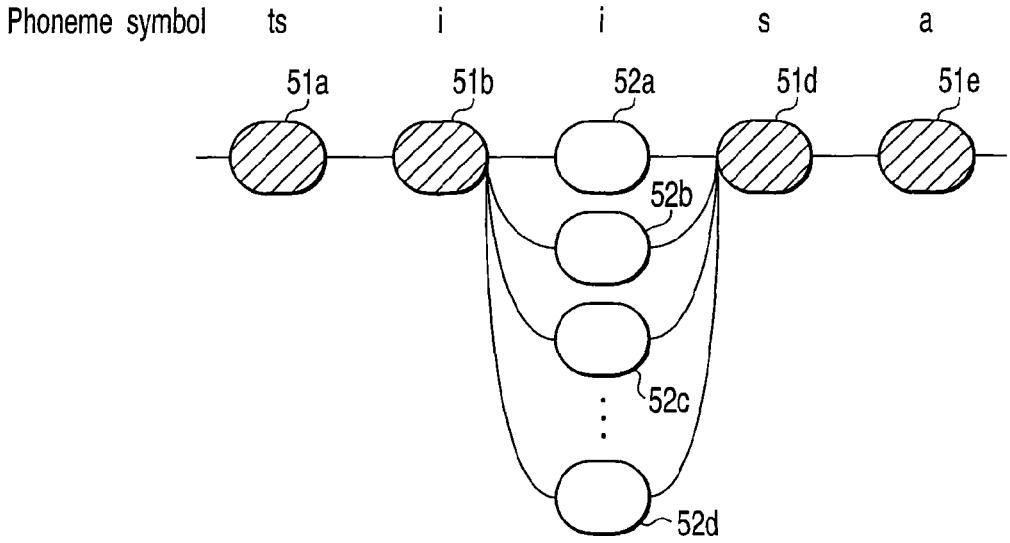
FIG. 8 is a view for explaining the sequence for obtaining a plurality of speech units for each of a plurality of segments corresponding to an input phoneme string.

For example, assume that the input phoneme string is "ts•i•i•s•a• . . . ", as shown in FIG. 8. In this case, synthesis units respectively correspond to phonemes "ts", "i", "i", "s", "a", . . . , each of which corresponds to one segment. FIG. 8 shows a case wherein a segment corresponding to the third phoneme "i" in the input phoneme string is selected as a target segment, and a plurality of speech units are obtained for this target segment. For segments other than that corresponding to the third phoneme "i", speech units 51*a*, 51*b*, 51*d*, 51*e*, . . . in the optimal speech unit sequence are fixed.

In this case, a cost is calculated using equation (5) for each of speech units having the same phoneme symbol (phoneme name) as the phoneme "i" of the target segment of those which are stored in the speech unit storing unit 1. Since costs which may have different values upon calculating costs for respective speech units are a target cost of the target segment, a concatenating cost between the target segment and immediately preceding segment, and a concatenating cost between the target segment and next segment, only these costs need only be taken into consideration. That is, (Procedure 1) One of a plurality of speech units having the same phoneme symbol as that of the phoneme "i" of the target segment of those which are stored in the speech unit storing unit 1 is selected as a speech unit $u_3$. A fundamental frequency cost is calculated using equation (1) from a fundamental frequency $f(v_3)$ of the speech unit $u_3$, and a target fundamental frequency $f(t_3)$.

(Procedure 2) A duration cost is calculated using equation (2) from a duration $g(v_3)$ of the speech unit $u_3$, and a target duration $g(t_3)$.

(Procedure 3) A first spectrum concatenating cost is calculated using equation (3) from a cepstrum coefficient $h(u_3)$ of the speech unit $u_3$, and a cepstrum coefficient $h(u_2)$ of the speech unit 51*b*. Also, a second spectrum concatenating cost is calculated using equation (3) from the cepstrum coefficient $h(u_3)$ of the speech unit $u_3$, and a cepstrum coefficient $h(u_4)$ of the speech unit 51*d*.

(Procedure 4) The weighted sum of the fundamental frequency cost, duration cost, and first and second spectrum concatenating costs calculated using the sub-cost functions in (procedure 1) to (procedure 3) above is calculated to calculate the cost of the speech unit $u_3$.

(Procedure 5) After costs are calculated for respective speech units having the same phoneme symbol as the phoneme "i" of the target segment of those which are stored in the speech unit storing unit 1 in accordance with (procedure 1) to (procedure 4) above, these costs are ranked so that a speech unit with the smallest value has the highest rank (step S113 in FIG. 7). Then, top M speech units are selected (step S114 in FIG. 7). For example, in FIG. 8 the speech unit 52*a* has the highest rank, and the speech unit 52*d* has the lowest rank.

(Procedure 1) to (procedure 5) above are applied to respective segments. As a result, M speech units are obtained for each of segments.

The process in step S102 in FIG. 3 will be described below.

In step S102, a new speech unit (fused speech unit) is generated by fusing M speech units selected for each of a plurality of segments in step S101. Since the wave of a voiced sound has a period, but that of an unvoiced sound has no period, this step executes different processes depending on whether a speech unit of interest is a voiced or unvoiced sound.

The process for a voiced sound will be explained below. In case of a voiced sound, pitch-cycle wave are extracted from the speech units, and are fused on the pitch-cycle wave level, thus generating a new pitch-cycle wave. The pitch-cycle wave means a relatively short wave, the length of which is up to several multiples of the fundamental frequency of speech, and which does not have any fundamental frequency by itself, and its spectrum represents the spectrum envelope of a speech signal.

As extraction methods of the pitch-cycle wave, various methods are available: a method of extracting a wave using a window synchronized with the fundamental frequency, a method of computing the inverse discrete Fourier transform of a power spectrum envelope obtained by cepstrum analysis or PSE analysis, a method of calculating a pitch-cycle wave based on an impulse response of a filter obtained by linear prediction analysis, a method of calculating a pitch-cycle wave which minimizes the distortion to natural speech on the level of synthetic speech by the closed loop training method, and the like.

In the first embodiment, the processing sequence will be explained below with reference to the flowchart of FIG. 9 taking as an example a case wherein pitch-cycle waves are extracted using the method of extracting them by a window (time window) synchronized with the fundamental frequency. The processing sequence executed when a new speech unit is generated by fusing M speech units for arbitrary one of a plurality of segments will be explained.

Figure 10:
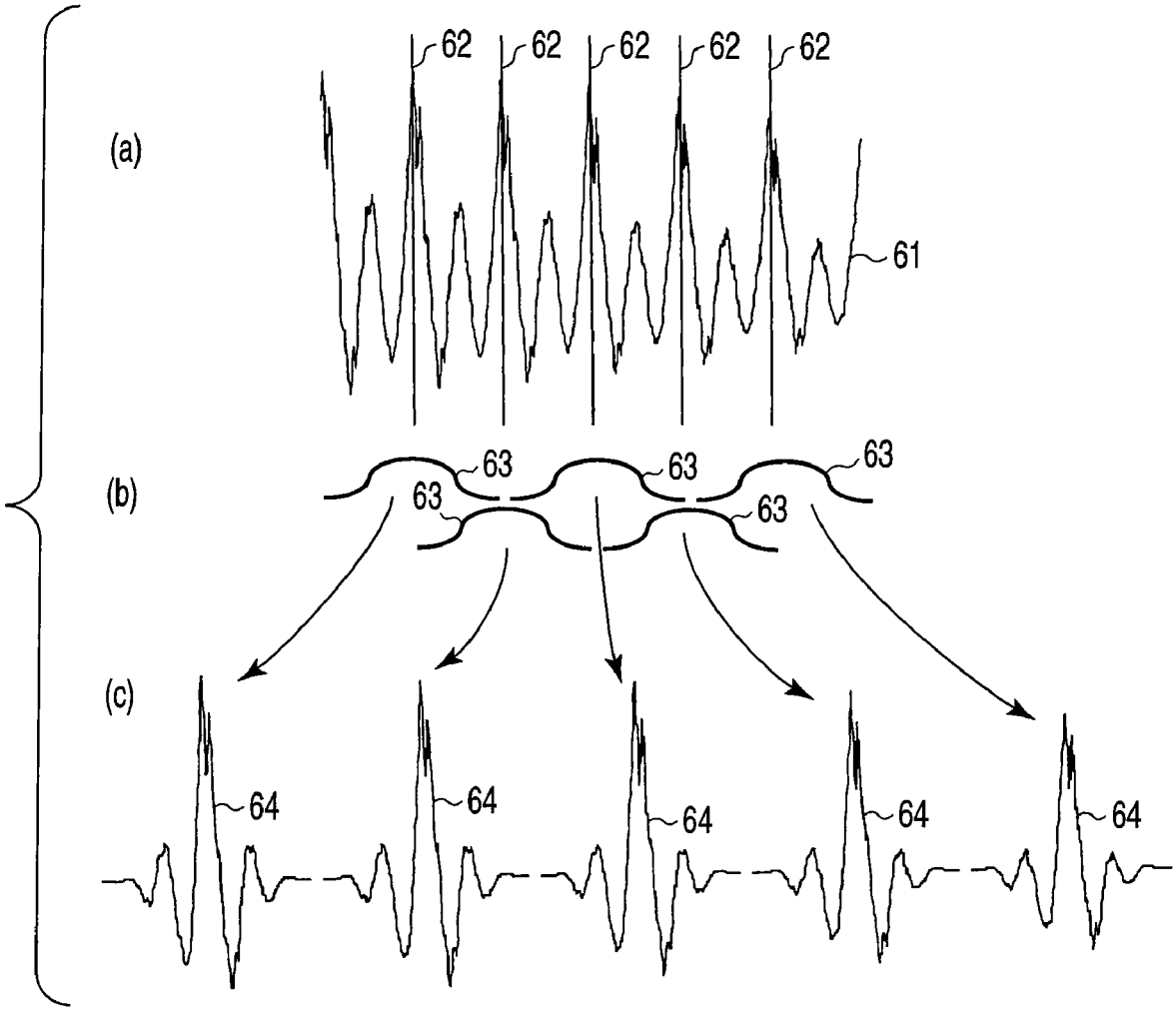
FIG. 10 is a view for explaining the processes of the speech unit fusing unit.

In step S121, marks (pitch marks) are assigned to a speech wave of each of M speech units at its periodic intervals. FIG. 10(*a*) shows a case wherein pitch marks 62 are assigned to a speech wave 61 of one of M speech units at its periodic intervals. In step S122, a window is applied with reference to the pitch marks to extract pitch-cycle waves, as shown in FIG. 10(*b*). A Hamming window 63 is used as the window, and its window length is twice the fundamental frequency. As shown in FIG. 10(*c*), windowed waves 64 are extracted as pitch-cycle waves. The process shown in FIG. 10 (that in step S122) is applied to each of M speech units. As a result, a pitch-cycle wave sequence including a plurality of pitch-cycle waves is obtained for each of the M speech units.

The flow then advances to step S123 to uniform the numbers of pitch-cycle waves by copying pitch-cycle waves (for a pitch-cycle wave sequence with the smaller number of pitch-cycle waves) so that all the M pitch-cycle wave sequences have the same number of pitch-cycle waves in correspondence with one, which has the largest number of pitch-cycle waves, of the pitch-cycle wave sequences of the M speech units of the segment of interest.

Figure 11:
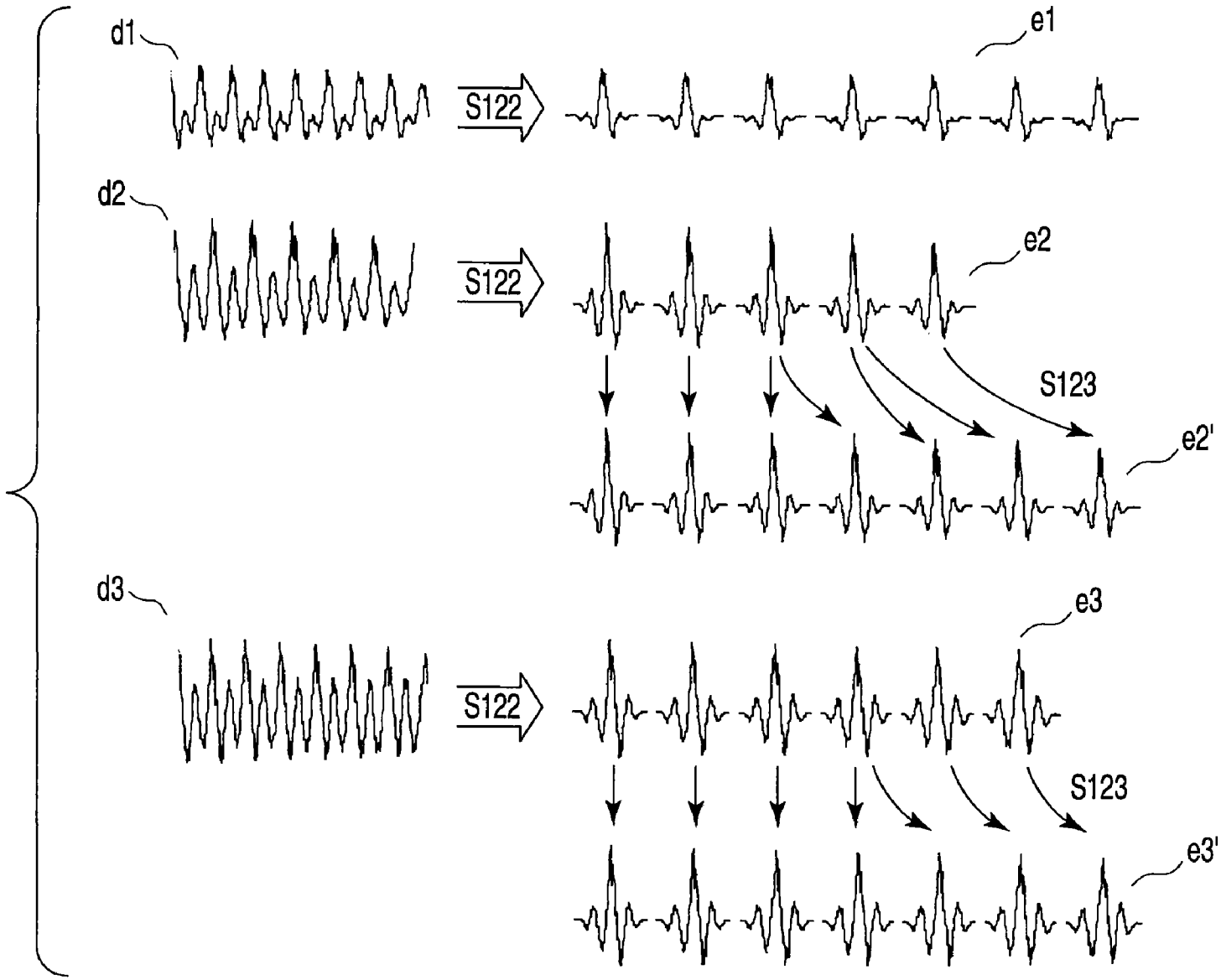
FIG. 11 is a view for explaining the processes of the speech unit fusing unit.

FIG. 11 shows pitch-cycle wave sequences e1 to e3 extracted in step S122 from M (for example, three in this case) speech units d1 to d3 of the segment of interest. The number of pitch-cycle waves in the pitch-cycle wave sequence e1 is seven, that of pitch-cycle waves in the pitch-cycle wave sequence e2 is five, and that of pitch-cycle waves in the pitch-cycle wave sequence e3 is six. Hence, of the pitch-cycle wave sequences e1 to e3, the sequence e1 has a largest number of pitch-cycle waves. Therefore, one of pitch-cycle waves in the sequence is copied in the remaining sequences e2 and e3 to form seven pitch-cycle waves. As a result, new pitch-cycle wave sequences e2' and e3' are obtained in correspondence with the sequences e2 and e3.

The flow advances to step S124. In this step, a process is done for each pitch-cycle wave. In step S124, pitch-cycle waves corresponding to M speech units of the segment of interest are averaged at their positions to generate a new pitch-cycle wave sequence. The generated new pitch-cycle wave sequence is output as a fused speech unit.

Figure 12:
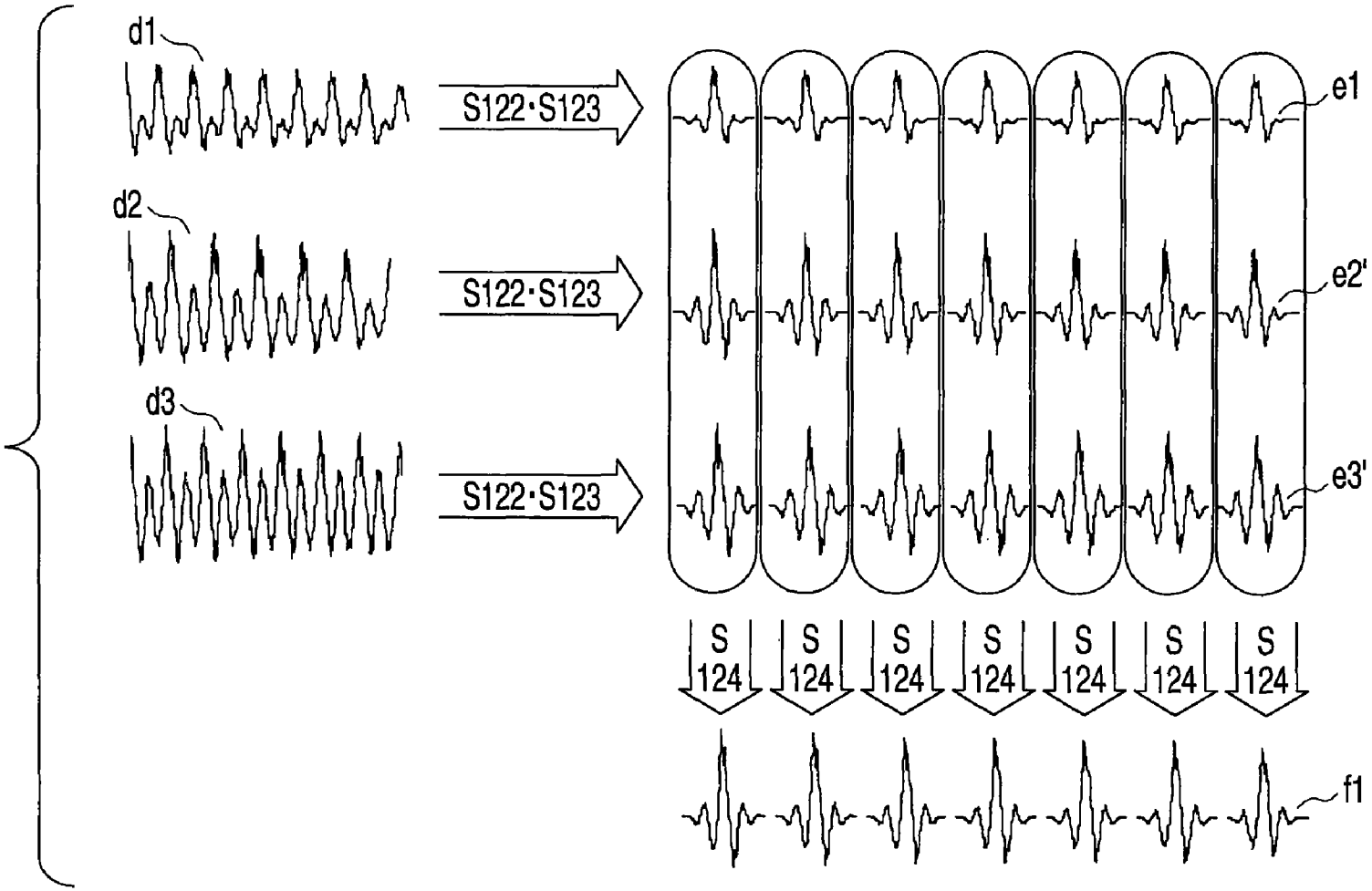
FIG. 12 is a view for explaining the processes of the speech unit fusing unit.

FIG. 12 shows the pitch-cycle wave sequences e1, e2', and e3' obtained in step S123 from the M (e.g., three in this case) speech units d1 to d3 of the segment of interest. Since each sequence includes seven pitch-cycle waves, the first to seventh pitch-cycle waves are averaged in the three speech units to generate a new pitch-cycle wave sequence f1 formed of seven, new pitch-cycle waves. That is, the centroid of the first pitch-cycle waves of the sequences e1, e2', and e3' is calculated, and is used as the first pitch-cycle wave of the new pitch-cycle wave sequence f1. The same applies to the second to seventh pitch-cycle waves of the new pitch-cycle wave sequence f1. The pitch-cycle wave sequence f1 is the "fused speech unit" described above.

On the other hand, the process in step S102 in FIG. 3, which is executed for a segment of an unvoiced sound, will be described below. In segment selection step S101, the M speech units of the segment of interest are ranked, as described above. Hence, the speech wave of the top ranked one of the M speech units of the segment of interest is directly used as a "fused speech unit" corresponding to that segment.

After a new speech unit (fused speech unit) is generated from M speech units (by fusing the M speech units for a voiced sound or selecting one of the M speech units for an unvoiced sound) which are selected for the segment of interest of a plurality of segments corresponding to the input phoneme string, the flow then advances to speech unit editing/concatenating step S103 in FIG. 3.

In step S103, the speech unit editing/concatenating unit 9 deforms and concatenates the fused speech units for respective segments, which are obtained in step S102, in accordance with the input prosodic information, thereby generating a speech wave (of synthetic speech). Since each fused speech unit obtained in step S102 has a form of pitch-cycle wave in practice, a pitch-cycle wave is superimposed so that the fundamental frequency and duration of the fused speech unit match those of target speech indicated by the input prosodic information, thereby generating a speech wave.

Figure 13:
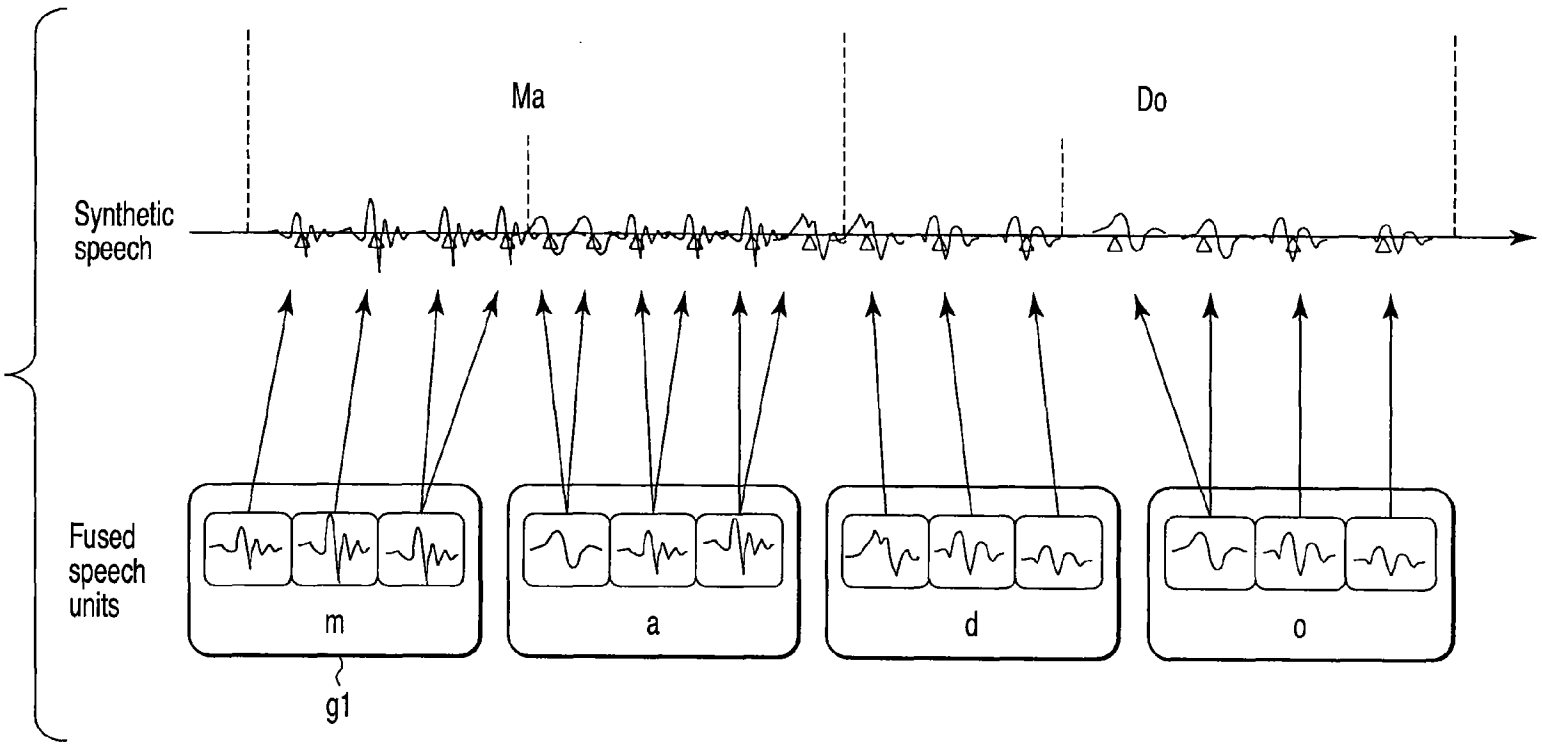
FIG. 13 is a view for explaining the processing operation of a speech unit editing/concatenating unit.

FIG. 13 is a view for explaining the process in step S103. FIG. 13 shows a case wherein a speech wave "mado ("window" in Japanese)" is generated by deforming and concatenating fused speech units obtained in step S102 for synthesis units of phonemes "m", "a", "d", and "o". As shown in FIG. 13, the fundamental frequency of each pitch-cycle waves in the fused speech unit is changed (by changing the pitch of sound) or the number of pitch-cycle waves is increased (to change a duration) in correspondence with the target fundamental frequency and target duration indicated by the input prosodic information. After that, neighboring pitch-cycle waves in each segments and between neighboring segments are concatenated to generate synthetic speech.

Note that the target cost can preferably estimate (evaluate) the distortion of synthetic speech to target speech, which is generated by changing the fundamental frequency, duration, and the like of each fused speech unit (by the speech unit editing/concatenating unit 9), as accurately as possible on the basis of the input prosodic information so as to generate the synthetic speech. The target cost calculated from equations (1) and (2) as an example of such target cost is calculated on the basis of the difference between the prosodic information of target speech and that of a speech unit stored in the speech unit storing unit 1. Also, the concatenating cost can preferably estimate (evaluate) the distortion of synthetic speech to target speech, which is generated upon concatenating the fused speech units (by the speech unit editing/concatenating unit 9), as accurately as possible. The concatenating cost calculated from equation (3) as an example of such concatenating cost is calculated on the basis of the difference between the cepstrum coefficients at concatenating boundaries of speech units stored in the speech unit storing unit 1.

The difference between the speech synthesis method according to the first embodiment and the conventional speech unit selection type speech synthesis method will be explained below.

The difference between the speech synthesis system shown in FIG. 2 according to the first embodiment and a conventional speech synthesis system (e.g., see patent reference 3) lies in that a plurality of speech units are selected for each synthesis unit upon selecting speech units, and the speech unit fusing unit 5 is connected after the speech unit selecting unit 11 to generate a new speech unit by fusing a plurality of speech units for each synthesis unit. In this embodiment, a high-quality speech unit can be generated by fusing a plurality of speech units for each synthesis unit and, as a result, natural, high-quality synthetic speech can be generated.

Second Embodiment

The speech synthesis unit 34 according to the second embodiment will be described below.

Figure 14:
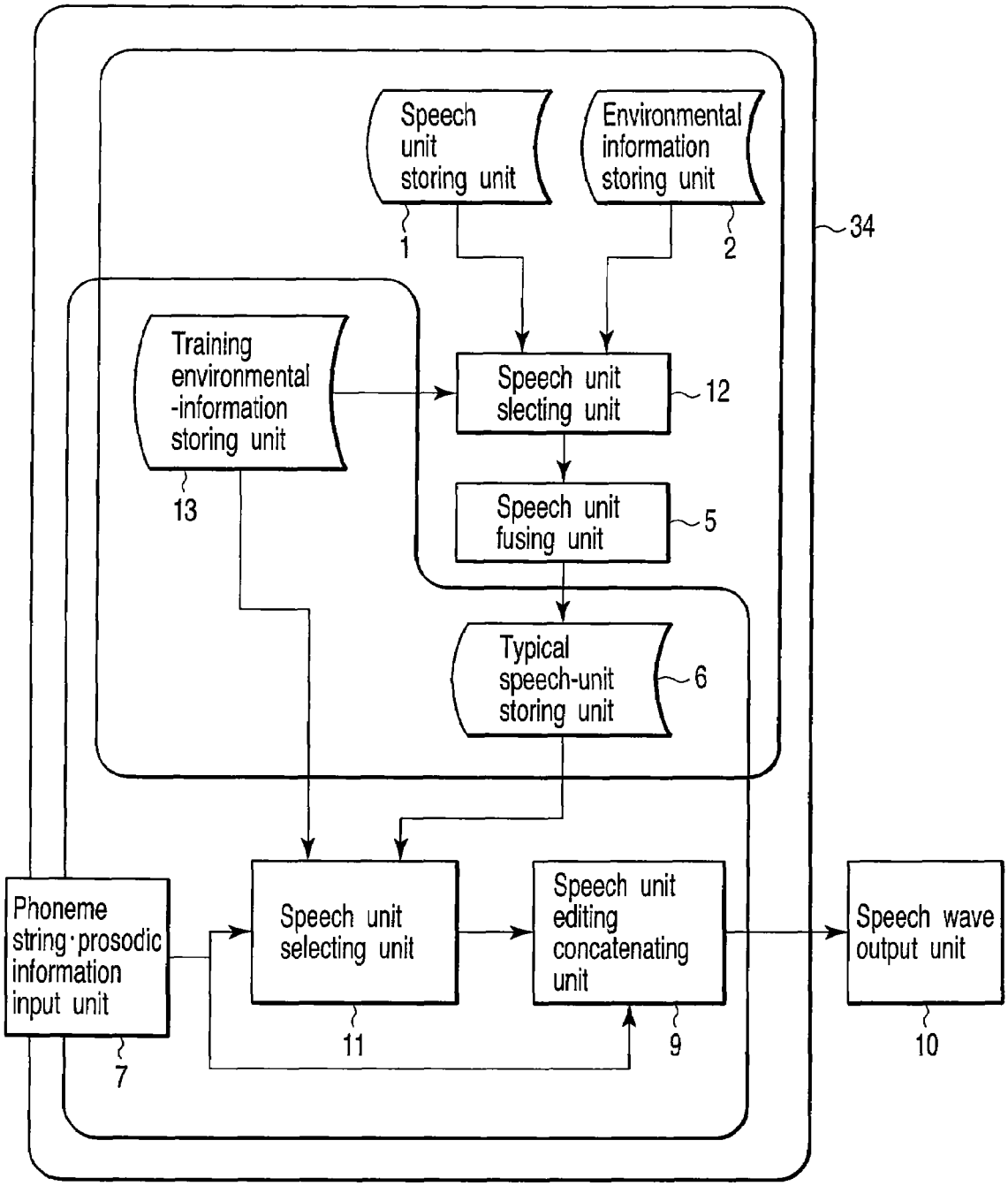
FIG. 14 is a block diagram showing an example of the arrangement of a speech synthesis unit according to the second embodiment of the present invention.

FIG. 14 shows an example of the arrangement of the speech synthesis unit 34 according to the second embodiment. The speech synthesis unit 34 includes a speech unit storing unit 1, environmental information storing unit 2, speech unit selecting unit 12, training (desired) environmental-information storing unit 13, speech unit fusing unit 5, typical phonetic-segment storing unit 6, phoneme string/prosodic information input unit 7, speech unit selecting unit 11, and speech unit editing/concatenating unit 9. Note that the same reference numerals in FIG. 14 denote the same parts as those in FIG. 2.

That is, the speech synthesis unit 34 in FIG. 14 roughly comprises a typical speech unit generating system 21, and rule synthesis system 22. The rule synthesis system 22 operates when text-to-speech synthesis is made in practice, and the typical speech unit generating system 21 generates typical speech units by learning in advance.

As in the first embodiment, the speech unit storing unit 1 stores a large number of speech units, and the environmental information storing unit 2 stores information of the phonetic environments of these speech units. The training environmental-information storing unit 13 stores a large number of pieces of training environmental-information used as targets upon generating typical speech units. As the training environments, the same contents as those of the environmental information stored in the environmental information storing unit 2 are used in this case.

An overview of the processing operation of the typical phonetic-segment generating system 21 will be explained first. The speech unit selecting unit 12 selects speech unit with environmental information which matches or is similar to each training environment which is stored in the training environmental-information storing unit 13 and is used as a target, from the speech unit storing unit 1. In this case, a plurality of speech units are selected. The selected speech units are fused by the speech unit fusing unit 5, as shown in FIG. 9. A new speech unit obtained as a result of this process, i.e., a "fused speech unit", is stored as a typical speech unit in the typical phonetic-segment storing unit 6.

The typical phonetic-segment storing unit 6 stores the waves of typical speech units generated in this way together with segment numbers used to identify these typical speech units in the same manner as in, e.g., FIG. 4. The training environmental-information storing unit 13 stores information of phonetic environments (training environmental information) used as targets used upon generating typical speech units stored in the typical phonetic-segment storing unit 6 in correspondence with the segment numbers of the typical speech units in the same manner as in, e.g., FIG. 5.

An overview of the processing operation of the rule synthesis system 22 will be explained below. The speech unit selecting unit 11 selects a typical speech unit, which is the one of a phoneme symbol (or phoneme symbol string) corresponding to a segment of interest of a plurality of segments obtained by segmenting a phoneme string input by synthesis units and has environmental information that matches or is similar to prosodic information input corresponding to that segment, from those stored in the typical phonetic-segment storing unit 6. As a result, a typical speech unit sequence corresponding to the input phoneme string is obtained. The typical speech unit sequence is deformed and concatenated by the speech unit editing/concatenating unit 9 on the basis of the input prosodic information to generate a speech wave. The speech wave generated in this way is output via the speech wave output unit 10.

The processing operation of the typical speech unit generating system 21 will be described in detail below with reference to the flowchart shown in FIG. 15.

The speech unit storing unit 1 and environmental information storing unit 2 respectively store a speech unit group and environmental information group as in the first embodiment. The speech unit selecting unit 12 selects a plurality of speech units each of which has environmental information that matches or is similar to that of each training environmental information stored in the environmental-information storing unit 13 (step S201). By fusing the plurality of selected speech units, a typical speech unit corresponding to the training environmental information of interest is generated (step S202).

A process for one training environmental information will be described below.

In step S201, a plurality of speech units are selected using the cost functions described in the first embodiment. In this case, since a speech unit is evaluated independently, no evaluation is made in association with the concatenating costs, but evaluation is made using only the target cost. That is, in this case, each environmental information having the same phoneme symbol as that included in training environmental information of those which are stored in the environmental information storing unit 2 is compared with training environmental information using equations (1) and (2).

Of a large number of pieces of environmental information stored in the environmental information storing unit 2, one of a plurality of pieces of environmental information having the same phoneme symbol as that included in training environmental information is selected as environmental information of interest. Using equation (1), a fundamental frequency cost is calculated from the fundamental frequency of the environmental information of interest and that (reference fundamental frequency) included in training environmental information. Using equation (2), a duration cost is calculated from the duration of the environmental information of interest and that (reference duration) included in training environmental information. The weighted sum of these costs is calculated using equation (4) to calculate a synthesis unit cost of the environmental information of interest. That is, in this case, the value of the synthesis unit cost represents the degree of distortion of a speech unit corresponding to environmental information of interest to that (reference speech unit) corresponding to training environmental information. Note that the speech unit (reference speech unit) corresponding to the training environmental information need not be present in practice. However, in this embodiment, an actual reference speech unit is present since environmental information stored in the environmental information storing unit 2 is used as training environmental information.

Synthesis unit costs are similarly calculated by setting each of a plurality of pieces of environmental information which are stored in the environmental information storing unit 2 and have the same phoneme symbol as that included in the training environmental information as the target environmental information.

Figure 15:
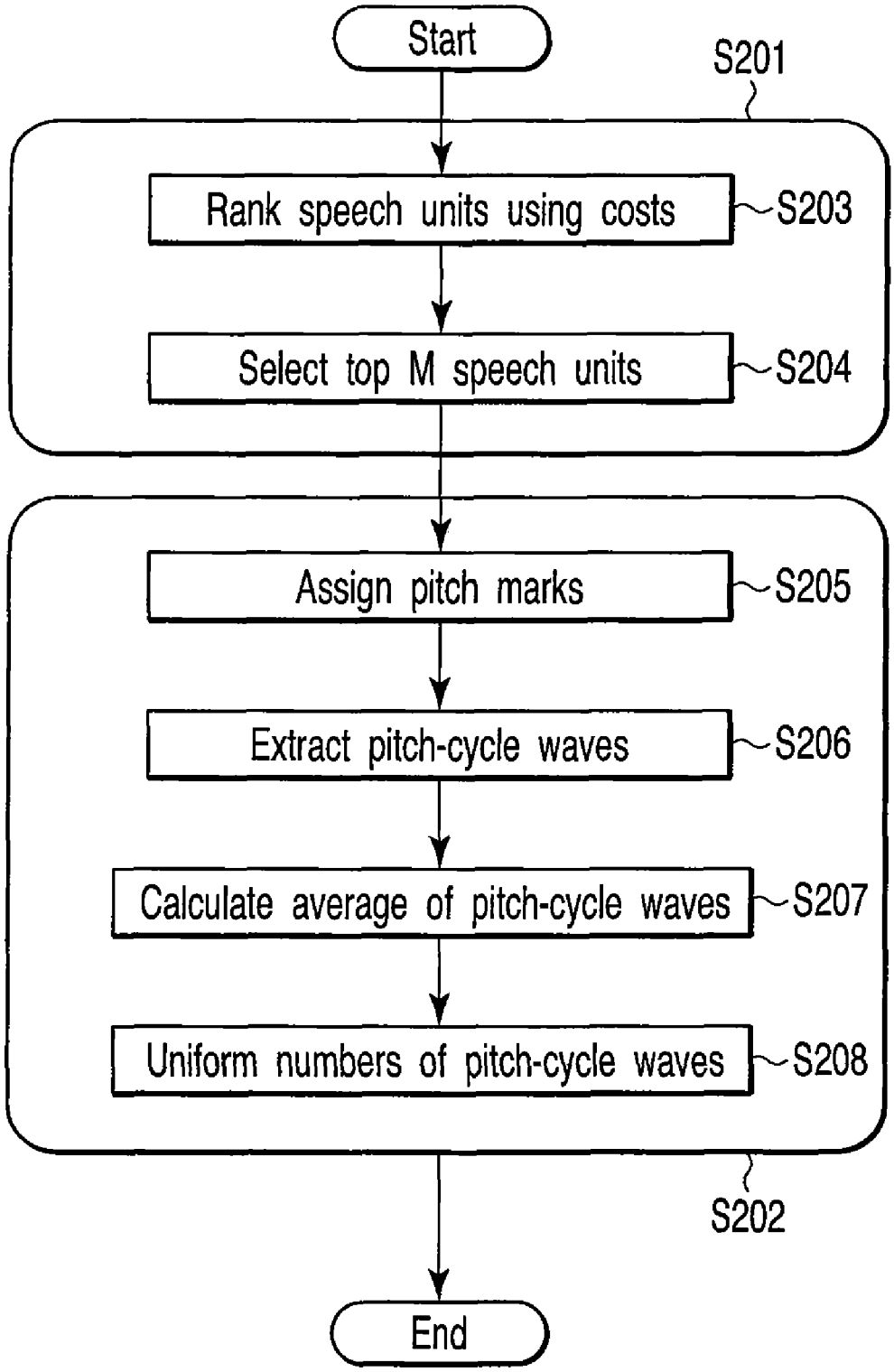
FIG. 15 is a flowchart for explaining the processing operation of generation of typical speech units in the speech synthesis unit shown in FIG. 14.

After the synthesis unit costs of the plurality of pieces of environmental information which are stored in the environmental information storing unit 2 and have the same phoneme symbol as that included in the training environmental information are calculated, they are ranked so that costs having smaller values have higher ranks (step S203 in FIG. 15). Then, M speech units corresponding to the top M pieces of environmental information are selected (step S204 in FIG. 15). The environmental information items corresponding to M speech units are similar to the training environmental information item.

The flow advances to step S202 to fuse speech units. However, when a phoneme of training environmental information corresponds to an unvoiced sound, the top ranked speech unit is selected as a typical speech unit. In case of a voiced sound, processes in steps S205 to S208 are executed. These processes are the same as those in the description of FIGS. 10 to 12. That is, in step S205 marks (pitch marks) are assigned to a speech wave of each of the selected M speech units at its periodic intervals. The flow advances to step S206 to apply a window with reference to the pitch marks to extract pitch-cycle waves. A Hamming window is used as the window, and its window length is twice the fundamental frequency. The flow advances to step S207 to uniform the numbers of pitch-cycle waves by copying pitch-cycle waves so that all the pitch-cycle wave sequences have the same number of pitch-cycle waves in correspondence with one, which has a largest number of pitch-cycle waves, of the pitch-cycle wave sequences. The flow advances to step S208. In this step, processes are done for each pitch-cycle wave. In step S208, M pitch-cycle waves are averaged (by calculating the centroid of M pitch-cycle waves) to generate a new pitch-cycle wave sequence. This pitch-cycle wave sequence serves as a typical speech unit. Note that steps S205 to S208 are the same as steps S121 to S124 in FIG. 9.

The generated typical speech unit is stored in the typical phonetic-segment storing unit 6 together with its segment number. The environmental information of that typical speech unit is training environmental information used upon generating the typical speech unit. This training environmental information is stored in the training environmental-information storing unit 13 together with the segment number of the typical speech unit. In this manner, the typical speech unit and training environmental information are stored in correspondence with each other using the segment number.

The rule synthesis system 22 will be described below. The rule synthesis system 22 generates synthetic speech using the typical speech units stored in the typical phonetic-segment storing unit 6, and environmental information which corresponds to each typical speech unit and is stored in the training environmental-information storing unit 13.

The speech unit selecting unit 11 selects one typical speech unit per synthesis unit (segment) on the basis of the phoneme string and prosodic information input to the phoneme string/prosodic information input unit 7 to obtain a speech unit sequence. This speech unit sequence is an optimal speech unit sequence described in the first embodiment, and is calculated by the same method as in the first embodiment, i.e., a string of (typical) speech units which can minimize the cost values given by equation (5) is calculated.

The speech unit editing/concatenating unit 9 generates a speech wave by deforming and concatenating the selected optimal speech unit sequence in accordance with the input prosodic information in the same manner as in the first embodiment. Since each typical speech unit has a form of pitch-cycle wave, a pitch-cycle wave is superimposed to obtain a target fundamental frequency and duration, thereby generating a speech wave.

The difference between the speech synthesis method according to the second embodiment and the conventional speech synthesis method will be explained below.

The difference between the conventional speech synthesis system (e.g., see Japanese Patent No. 2,583,074) and the speech synthesis system shown in FIG. 14 according to the second embodiment lies in the method of generating typical speech units and the method of selecting typical speech units upon speech synthesis. In the conventional speech synthesis system, speech units used upon generating typical speech units are classified into a plurality of clusters associated with environmental information on the basis of distance scales between speech units. On the other hand, the speech synthesis system of the second embodiment selects speech units which match or are similar to training environmental information by inputting the training environmental information and using cost functions given by equations (1), (2), and (4) for each target environmental information.

Figure 16:
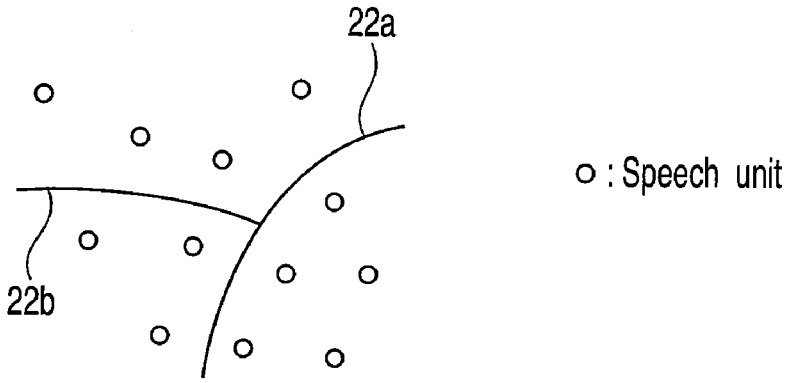
FIG. 16 is a view for explaining the generation method of typical speech units by conventional clustering.
Figure 17:
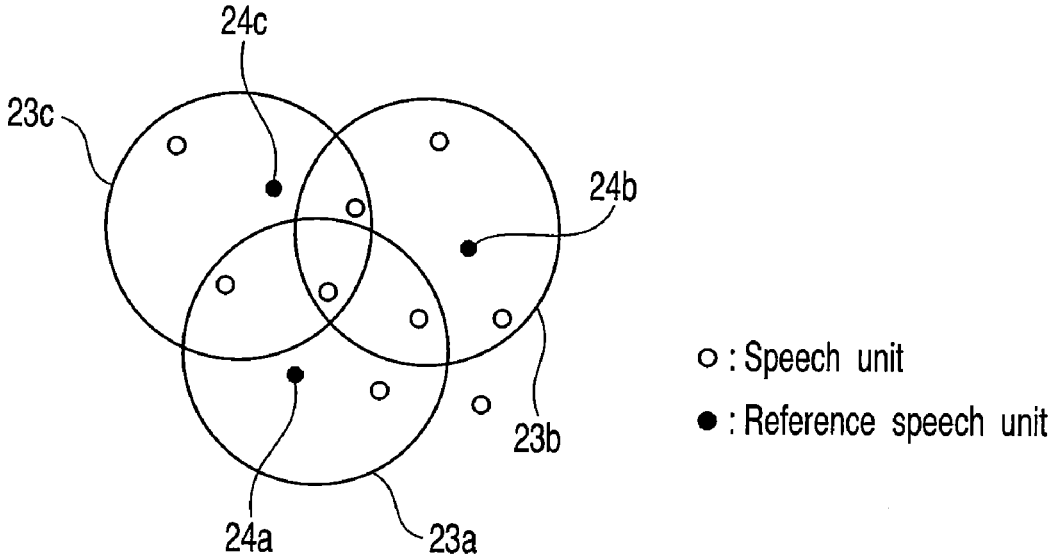
FIG. 17 is a view for explaining the method of generating speech units by selecting segments using a cost function according to the present invention.

FIG. 16 illustrates the distribution of phonetic environments of a plurality of speech units having different environmental information, i.e., a case wherein a plurality of speech units for generating a typical speech unit in this distribution state are classified and selected by clustering. FIG. 17 illustrates the distribution of phonetic environments of a plurality of speech units having different environmental information, i.e., a case wherein a plurality of speech units for generating a typical speech unit are selected using cost functions.

As shown in FIG. 16, in the prior art, each of a plurality of stored speech units is classified into one of three clusters depending on whether its fundamental frequency is equal to or larger than a first predetermined value, is less than a second predetermined value, or is equal to or larger than the second predetermined value and is less than the first predetermined value. Reference numerals 22*a* and 22*b* denote cluster boundaries.

On the other hand, as shown in FIG. 17, in the second embodiment, each of a plurality of speech units stored in the speech unit storing unit 1 is set as a reference speech unit, environmental information of the reference speech unit is set as training environmental information, and a set of speech units having environmental information that matches or is similar to the training environmental information is obtained. For example, in FIG. 17, a set 23*a* of speech units with environmental information which matches or is similar to reference training environmental information 24*a* is obtained. A set 23*b* of speech units with environmental information which matches or is similar to reference training environmental information 24*b* is obtained. Also, a set 23*c* of speech units with environmental information which matches or is similar to reference training environmental information 24*c* is obtained.

As can be seen from comparison between FIGS. 16 and 17, according to the clustering method of FIG. 16, no speech units are repetitively used in a plurality of typical speech units upon generating typical speech units. However, in the second embodiment shown in FIG. 17, some speech units are repetitively used in a plurality of typical speech units upon generating typical speech units. In the second embodiment, since target environmental information of a typical speech unit can be freely set upon generating that typical speech unit, a typical speech unit with required environmental information can be freely generated. Therefore, many typical speech units with phonetic environments which are not included in the speech units stored in the speech unit storing unit 1 and are not sampled in practice can be generated depending on the method of selecting reference speech units.

As the selection range is broadened with increasing the number of typical speech units with different phonetic environments, more natural, higher-quality synthetic speech can be consequently obtained.

The speech synthesis system of the second embodiment can generate a high-quality speech unit by fusing a plurality of speech units with similar phonetic environments. Furthermore, since training phonetic environments are prepared as many as those which are stored in the environmental information storing unit 2, typical speech units with various phonetic environments can be generated. Therefore, the speech unit selecting unit 11 can select many typical speech units, and can reduce distortions produced upon deforming and concatenating speech units by the speech unit editing/concatenating unit 9, thus generating natural synthetic speech with higher quality. In the second embodiment, since no speech unit fusing process is required upon making text-to-speech synthesis in practice, the computation volume is smaller than the first embodiment.

Third Embodiment

In the first and second embodiments, the phonetic environment is explained as information of a phoneme of a speech unit and its fundamental frequency and duration. However, the present invention is not limited to such specific factors. A plurality of pieces of information such as a phoneme, fundamental frequency, duration, preceding phoneme, succeeding phoneme, second succeeding phoneme, fundamental frequency, duration, power, presence/absence of stress, position from an accent nucleus, time from breath pause, utterance speed, emotion, and the like are used in combination as needed. Using appropriate factors as phonetic environments, more appropriate speech units can be selected in the speech unit selection process in step S101 in FIG. 3, thus improving the quality of speech.

Fourth Embodiment

In the first and second embodiments, the fundamental frequency cost and duration cost are used as target costs. However, the present invention is not limited to these specific costs. For example, a phonetic environment cost which is prepared by digitizing the difference between the phonetic environment of each speech unit stored in the speech unit storing unit 1 and the target phonetic environment may be used. As phonetic environments, the types of phonemes allocated before and after a given phoneme, a part of speech of a word including that phoneme, and the like may be used.

In this case, a new sub-cost function required to calculate the phonetic environment cost that represents the difference between the phonetic environment of each speech unit stored in the speech unit storing unit 1 and the target phonetic environment is defined. Then, the weighted sum of the phonetic environment cost calculated using this sub-cost function, the target costs calculated using equations (1) and (2), and the concatenating cost calculated using equation (3) is calculated using equation (4), thus obtaining a synthesis unit cost.

Fifth Embodiment

In the first and second embodiments, the spectrum concatenating cost as the spectrum difference at the concatenating boundary is used as the concatenating cost. However, the present invention is not limited to such specific cost. For example, a fundamental frequency concatenating cost that represents the fundamental frequency difference at the concatenating boundary, a power concatenating cost that represents the power difference at the concatenating boundary, and the like may be used in place of or in addition to the spectrum concatenating cost.

In this case as well, new sub-cost functions required to calculate these costs are defined. Then, the weighted sum of the concatenating costs calculated using these sub-cost functions, and the target costs calculated using equations (1) and (2) is calculated using equation (4), thus obtaining a synthesis unit cost.

Sixth Embodiment

In the first and second embodiments, all weights $w_n$ are set to be "1". However, the present invention is not limited to such specific value. The weights are set to be appropriate values in accordance with sub-cost functions. For example, synthetic tones are generated by variously changing the weight values, and a value with the best evaluation result is checked by subjective evaluation tests. Using the weight value used at that time, high-quality synthetic speech can be generated.

Seventh Embodiment

In the first and second embodiments, the sum of synthesis unit costs is used as the cost function, as given by equation (5). However, the present invention is not limited to such specific cost function. For example, the sum of powers of synthesis unit costs may be used. Using a larger exponent of the power, larger synthesis unit costs are emphasized, thus avoiding a speech unit with a large synthesis unit cost from being locally selected.

Eighth Embodiment

In the first and second embodiments, the sum of synthesis unit costs as the weighted sum of sub-cost functions is used as the cost function, as given by equation (5). However, the present invention is not limited to such specific cost function. A function which includes all sub-cost functions of a speech unit sequence need only be used.

Ninth Embodiment

In speech unit selection step S112 in FIG. 7 of the first embodiment, and speech unit selection step S201 in FIG. 15 of the second embodiment, M speech units are selected per synthesis unit. However, the present invention is not limited to this. The number of speech units to be selected may be changed for each synthesis unit. Also, a plurality of speech units need not be selected in all synthesis units. Also, the number of speech units to be selected may be determined based on some factors such as cost values, the number of speech units, and the like.

10th Embodiment

In the first embodiment, in steps S111 and S112 in FIG. 7, the same functions as given by equations (1) to (5) are used. However, the present invention is not limited to this. Different functions may be defined in these steps.

11th Embodiment

In the second embodiment, the speech unit selecting units 12 and 11 in FIG. 14 use the same functions as given by equations (1) to (5). However, the present invention is not limited to this. These units may use different functions.

12th Embodiment

Figure 9:
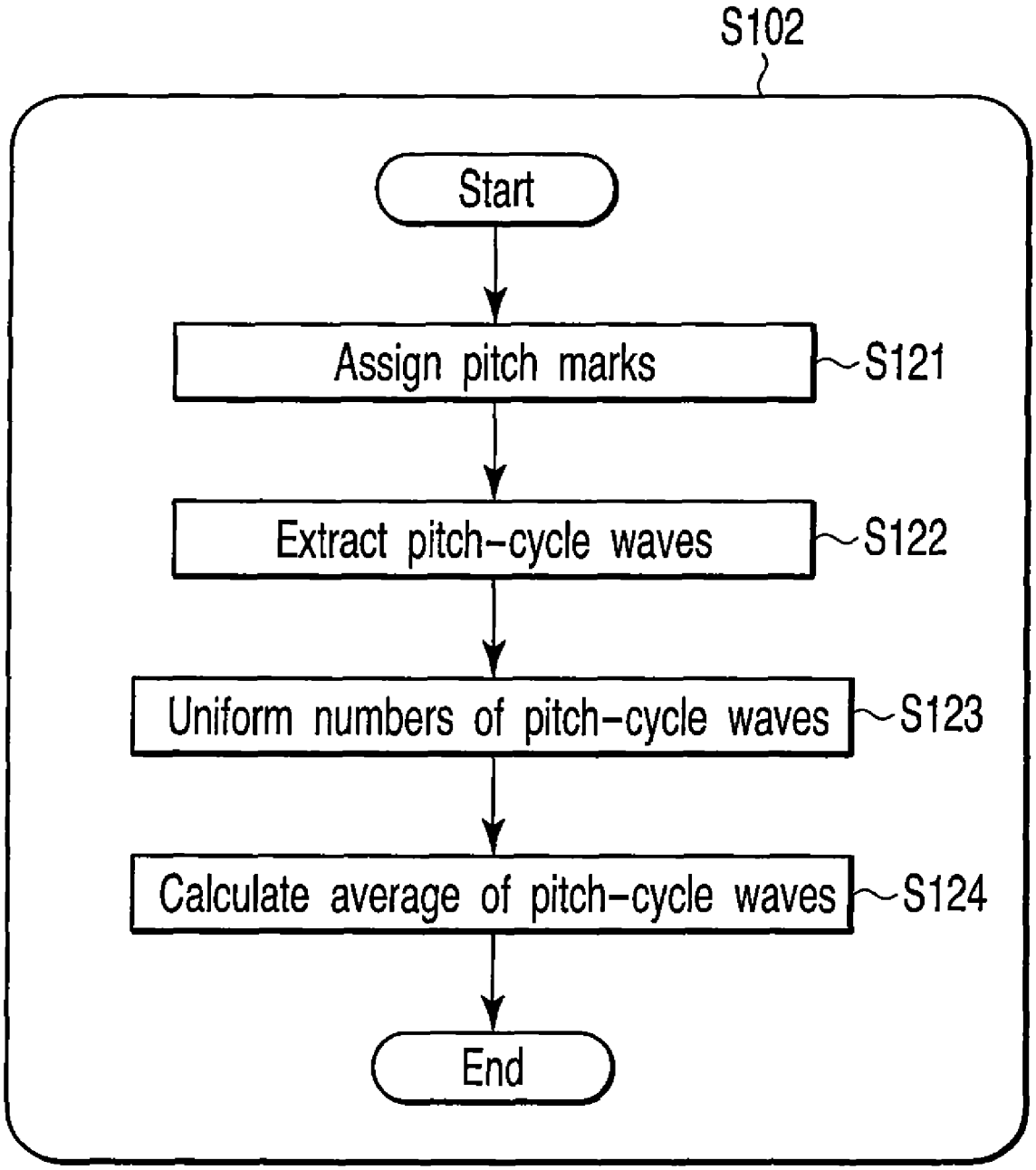
FIG. 9 is a flowchart for explaining the processing operation of a speech unit fusing unit.

In step S121 in FIG. 9 of the first embodiment and step S205 in FIG. 15 of the second embodiment, pitch marks are assigned to each speech unit. However, the present invention is not limited to such specific process. For example, pitch marks may be assigned to each speech unit in advance, and such segment may be stored in the speech unit storing unit 1. By assigning pitch marks to each speech unit in advance, the computation volume upon execution can be reduced.

13th Embodiment

In step S123 in FIG. 9 of the first embodiment and step S207 in FIG. 15 of the second embodiment, the numbers of pitch-cycle waves of speech units are adjusted in correspondence with a speech unit with the largest number of pitch-cycle waves. However, the present invention is not limited to this. For example, the number of pitch-cycle waves which are required in practice in the speech unit editing/concatenating unit 9 may be used.

14th Embodiment

In speech unit fusing step S102 in FIG. 3 of the first embodiment and speech unit fusing step S202 in FIG. 15 of the second embodiment, an average is used as means for fusing pitch-cycle waves upon fusing speech units of a voiced sound. However, the present invention is not limited to this. For example, pitch-cycle waves may be averaged by correcting pitch marks to maximize the correlation value of pitch-cycle waves in place of a simple averaging process, thus generating synthetic tones with higher quality. Also, the averaging process may be done by dividing pitch marks into frequency bands, and correcting the pitch marks to maximize correlation values for respective frequency bands, thus generating synthetic tones with higher quality.

15th Embodiment

In speech unit fusing step S102 in FIG. 3 of the first embodiment and speech unit fusing step S202 in FIG. 15 of the second embodiment, speech units of a voiced sound are fused on the level of pitch-cycle waves. However, the present invention is not limited to this. For example, using the closed loop training method described in Japanese Patent No. 3,281,281, a pitch-cycle wave sequence which is optimal on the level of synthetic tones can be generated without extracting pitch-cycle waves of each speech unit.

A case will be explained below wherein speech units of a voiced sound are fused using the closed loop training method. Since a speech unit is obtained as a pitch-cycle wave sequence by fusing as in the first embodiment, a vector u which is defined by coupling these pitch-cycle waves expresses a speech unit. Initially, an initial value of a speech unit is prepared. As the initial value, a pitch-cycle wave sequence obtained by the method described in the first embodiment may be used, or random data may be used. Let $r_j$ (j=1, 2, . . . M) be a vector that represents the wave of a speech unit selected in speech unit selection step S101. Using u, speech is synthesized to have $r_j$ as a target. Let $s_j$ be a generated synthetic speech segment. $s_j$ is given by the product of a matrix $A_j$ and u that represent superposition of pitch-cycle waves.

$$s_j = A_j u \tag{6}$$

Figure 18:
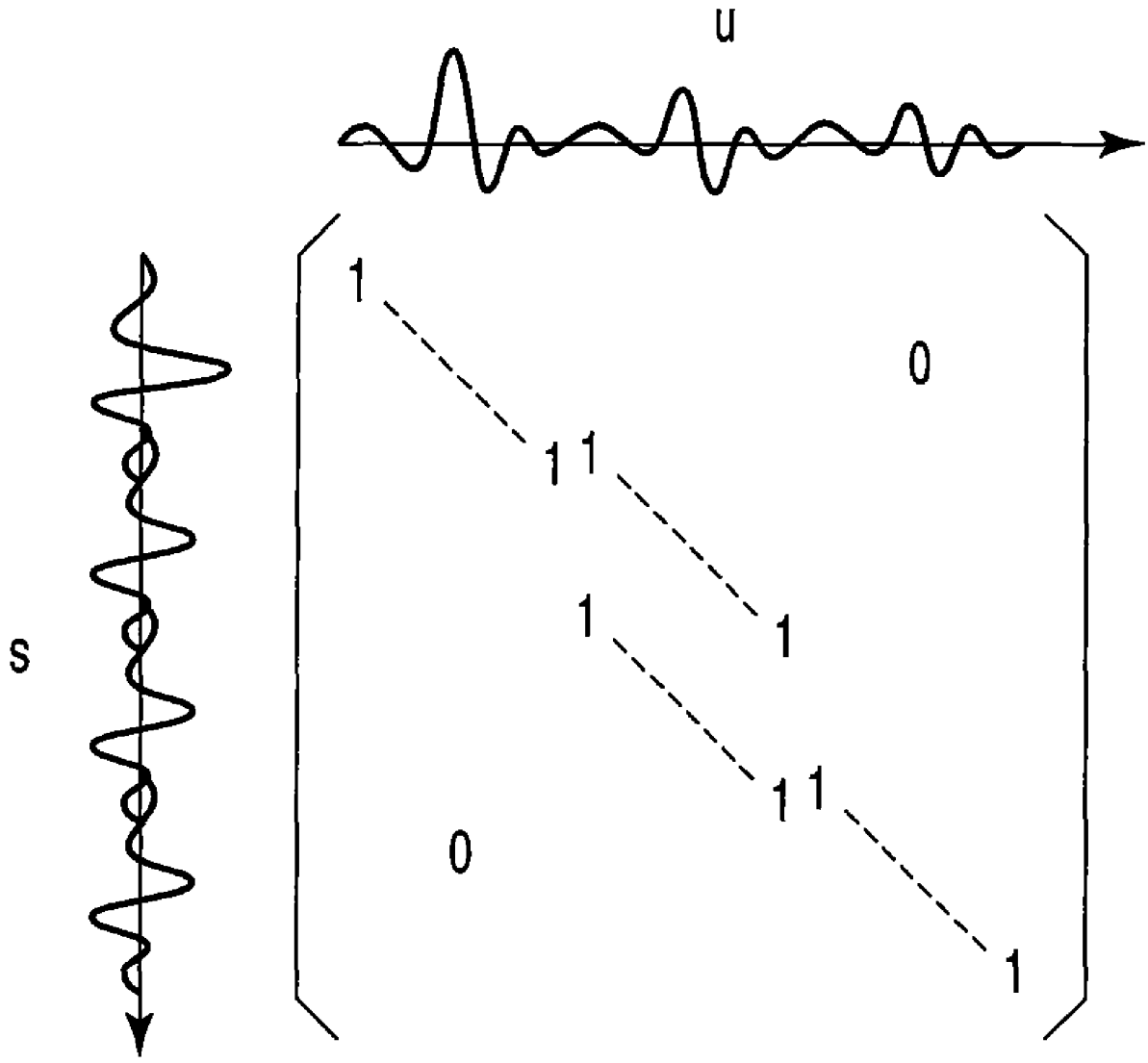
FIG. 18 is a view for explaining the closed loop training method, and shows an example of a matrix that represents superposition of pitch-cycle waves of given speech units.

The matrix $A_j$ is determined by mapping of pitch marks of $r_j$ and the pitch-cycle waves of u, and the pitch mark position of $r_j$. FIG. 18 shows an example of the matrix $A_j$.

An error between the synthetic speech segment $s_j$ and $r_j$ is then evaluated. An error $e_j$ between $s_j$ and $r_j$ is defined by:

$$\begin{aligned} e_j &= (r_j - g_j s_j)^T (r_j - g_j s_j) \\ &= (r_j - g_j A_j u)^T (r_j - g_j A_j u) \end{aligned} \tag{7}$$

As given by equations (8) and (9), $g_j$ is the gain used to evaluate only the distortion of a wave by correcting the average power difference between two waves, and the gain that minimizes $e_j$ is used.

$$\frac{\partial e_j}{\partial g_j} = 0 \tag{8}$$

$$g_j = \frac{s_j^T r_j}{s_j^T s_j} \tag{9}$$

An evaluation function E that represents the sum total of errors for all vectors ri is defined by:

$$E = \sum_{j=1}^{M} (r_j - g_j A_j u)^T (r_j - g_j A_j u) \tag{10}$$

An optimal vector u that minimizes E is obtained by solving equation (12) below obtained by partially differentiating E by u and equating the result by "0":

$$\frac{\partial E}{\partial u} = 0 \tag{11}$$

$$\left( \sum_{j=1}^{M} g_j^2 A_j^T A_j \right) u = \sum_{j=1}^{M} g_j A_j^T r_j \tag{12}$$

Equation (8) is a simultaneous equation for u, and a new speech unit u can be uniquely obtained by solving this. When the vector u is updated, the optimal gain gj changes. Hence, the aforementioned process is repeated until the value E converges, and the vector u at the time of convergence is used as a speech unit generated by fusing.

The pitch mark positions of $r_j$ upon calculating the matrix $A_j$ may be corrected on the basis of correlation between the waves of $r_j$ and u.

Also, the vector $r_j$ may be divided into frequency bands, and the aforementioned closed loop training method is executed for respective frequency bands to calculate "u"s. By summing up "u"s for all the frequency bands, a fused speech unit may be generated.

In this way, using the closed loop training method upon fusing speech units, a speech unit which suffers less deterioration of synthetic speech due to a change in pitch period can be generated.

16th Embodiment

In the first and second embodiments, speech units stored in the speech unit storing unit 1 are waves. However, the present invention is not limited to this, and spectrum parameters may be stored. In this case, the fusing process in speech unit fusing step S102 or S202 can use, e.g., a method of averaging spectrum parameters, or the like.

17th Embodiment

In speech unit fusing step S102 in FIG. 3 of the first embodiment and speech unit fusing step S202 in FIG. 15 of the second embodiment, in case of an unvoiced sound, a speech unit which is ranked first in speech unit selection steps S101 and S201 is directly used. However, the present invention is not limited to this. For example, speech units may be aligned, and may be averaged on the wave level. After alignment, parameters such as cepstra, LSP, or the like of speech units may be obtained, and may be averaged. A filter obtained based on the averaged parameter may be driven by white noise to obtain a used wave of an unvoiced sound.

18th Embodiment

In the second embodiment, the same phonetic environments as those stored in the environmental information storing unit 2 are stored in the training environmental-information storing unit 13. However, the present invention is not limited to this. By designing training environmental information in consideration of the balance of environmental information so as to reduce the distortion produced upon editing/concatenating speech units, synthetic speech with higher quality can be generated. By reducing the number of pieces of training environmental information, the capacity of the typical phonetic-segment storing unit 6 can be reduced.

As described above, according to the above embodiments, high-quality speech units can be generated for each of a plurality of segments which are obtained by segmenting a phoneme string of target speech by synthesis units. As a result, natural synthetic tones with higher quality can be generated.

By making a computer execute processes in the functional units of the text-to-speech system described in the above embodiments, the computer can function as the text-to-speech system. A program which can make the computer function as the text-to-speech system and can be executed by the computer can be stored in a computer readable medium such as a magnetic disk (flexible disk, hard disk, or the like), optical disk (CD-ROM, DVD, or the like), a semiconductor memory, or the like, and can be distributed.

What is claimed is:

1. A speech synthesis method comprising:

storing a group of speech units in a memory;

segmenting a phoneme string of a target speech, to obtain a plurality of segments;

selecting, from the group in the memory, a speech unit for each of the segments based on prosodic information of the target speech, to obtain an optimal speech unit sequence including speech units selected for the respective segments;

selecting M (M represents a positive integer greater than one) speech units for each of the segments from the group in the memory, based on the optimal speech unit sequence;

generating a new speech unit corresponding to each of the segments, by fusing the M speech units selected for said each of the segments, to obtain a plurality of new speech units corresponding to the segments respectively; and generating synthetic speech by concatenating the new speech units.

2. A method according to claim 1, wherein the prosodic information includes at least one of fundamental frequency, duration, and power of the target speech.

3. A method according to claim 1, wherein selecting the M speech units for each of the segments includes:

setting each segment of the segments as a target segment;

calculating a first cost for each speech unit of the group in the memory, the first cost representing difference between the target segment in the target speech and the speech unit of the group;

calculating a second cost for each speech unit of the group in the memory, the second cost representing a degree of distortion produced when the speech unit of the group is concatenated with speech units around the target segment in the optimal speech unit sequence; and selecting the M speech units for the target segment based on the first cost and the second cost of the each speech unit of the group.

4. A method according to claim 3, wherein the first cost is calculated using at least one of a fundamental frequency, duration, power, phonetic environment, and spectrum of the each one of the group and the target speech.

5. A method according to claim 3, wherein the second cost is calculated using at least one of a spectrum, fundamental frequency, and power of the each one of the group and another of the group.

6. A method according to claim 1, wherein the generating the new speech unit includes generating a plurality of pitch-cycle waveform sequences each including the same numbers of pitch-cycle waveforms, from M pitch-cycle waveform sequences corresponding to the M speech units selected respectively; and generating the new speech unit by fusing the M pitch-cycle waveform sequences generated.

7. A method according to claim 6, wherein the new speech units is generated by calculating a centroid of each pitch-cycle waveform of the new speech unit.

8. A speech synthesis system comprising:

a memory to store a group of speech units;

a first selecting unit configured to select, from the group in the memory, a speech unit for each of segments which are obtained by segmenting a phoneme string of a target speech, based on prosodic information of the target speech, to obtain an optimal speech unit sequence including speech units selected for the respective segments;

a second selecting unit configured to select, based on the optimal speech unit sequence, M (M represents a positive integer greater than one) speech units for each segment of the segments from the group in the memory;

a first generating unit configured to generate a new speech unit corresponding to each segment of the segments, by fusing the M speech units selected for the segment, to obtain a plurality of new speech units corresponding to the segments respectively; and a second generating unit configured to generate synthetic speech by concatenating the new speech units.

9. A non-transitory computer readable medium storing program instructions which when executed by a computer results in performance of steps comprising:

selecting from a first group of speech units in a first memory, a speech unit per each of segments which are obtained by segmenting a phoneme string of a target speech, based on prosodic information of the target speech, to obtain an optimal speech unit sequence including speech units selected for the respective segments;

selecting M (M represents a positive integer greater than one) speech units for each of the segments from the first group in the first memory, based on the optimal speech unit sequence;

generating a new speech unit corresponding to each segment of the segments, by fusing the M speech units selected for the segment, to obtain a plurality of new speech units corresponding to the segments respectively; and generating synthetic speech by concatenating the new speech units.

10. The non-transitory computer readable medium of claim 9, further storing a program instruction to generate a speech unit of the first group in the first memory by fusing a plurality of speech units whose environmental information items being similar to a desired environmental information item and are selected from a second group of speech units stored in a second memory.

* * * * *